US005315760A

United States Patent [19]

Emerson

[11] Patent Number: 5,315,760

[45] Date of Patent: May 31, 1994

[54] RAZOR KNIFE WITH BUILT-IN PENCIL SHARPENER

[76] Inventor: Stephen W. Emerson, 7004 Clovernook Ave., Floor 1, Cincinnati, Ohio 45231

[21] Appl. No.: 61,260

[22] Filed: May 17, 1993

[51] Int. Cl.[5] ..... D25F 3/00

[52] U.S. Cl. ..... 30/123; 7/160; 362/120

[58] Field of Search ..... 30/123, 124, 125, 138, 30/457; 362/119, 120; 7/158, 160, 167

[56] References Cited

U.S. PATENT DOCUMENTS 4,348,809 9/1982 Jackson ..... 30/138
4,669,186 6/1987 Liu ..... 362/119
4,891,881 1/1990 Mills ..... 30/123
5,023,761 6/1991 de Lange ..... 362/120
5,040,256 8/1991 Mills ..... 30/138

FOREIGN PATENT DOCUMENTS 842769 7/1960 United Kingdom ..... 362/120

*Primary Examiner*—Richard H. Seidel
*Assistant Examiner*—Hwei-Siu Payer
*Attorney, Agent, or Firm*—E. Michael Combs

[57] ABSTRACT

A utility razor knife for use by carpenters and the like is arranged to include a reciprocating blade mounted to a forward end of the structure, with a rearwardmost end of the housing structure including a pencil sharpener structure permitting access in the sharpening of a pencil in association with the knife blade arrangement.

3 Claims, 4 Drawing Sheets

FIG. 1
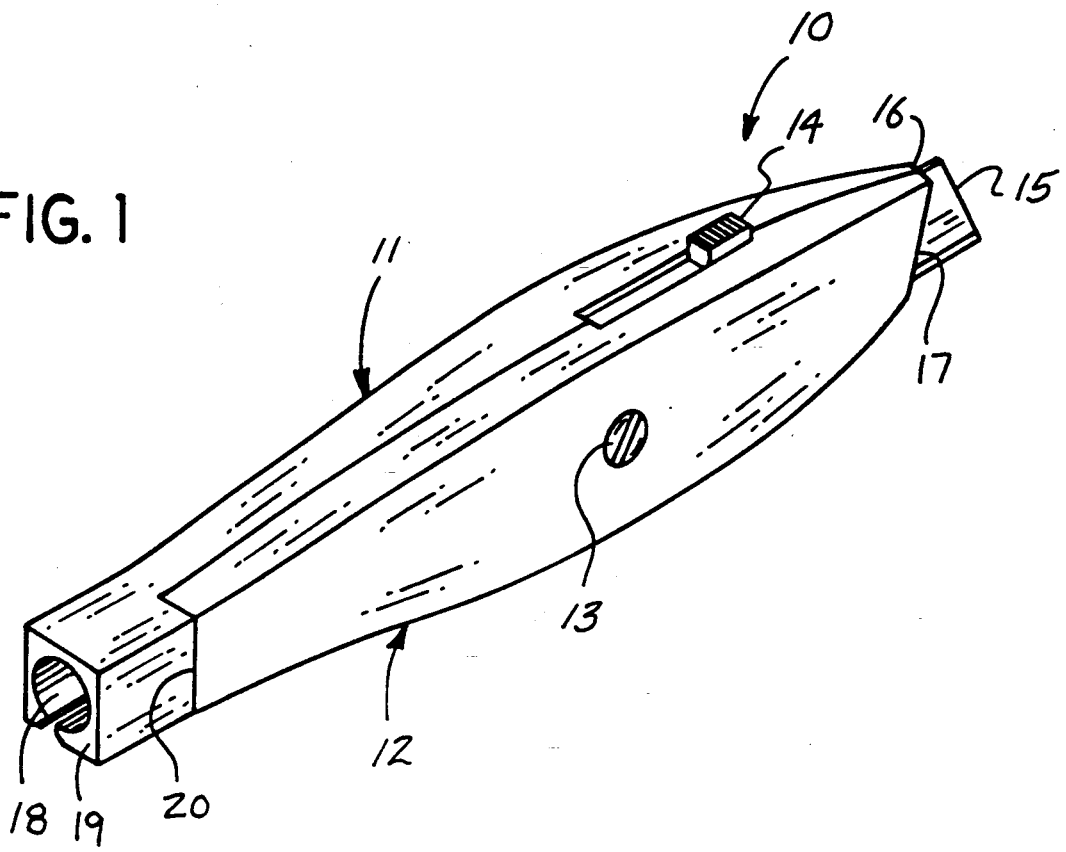
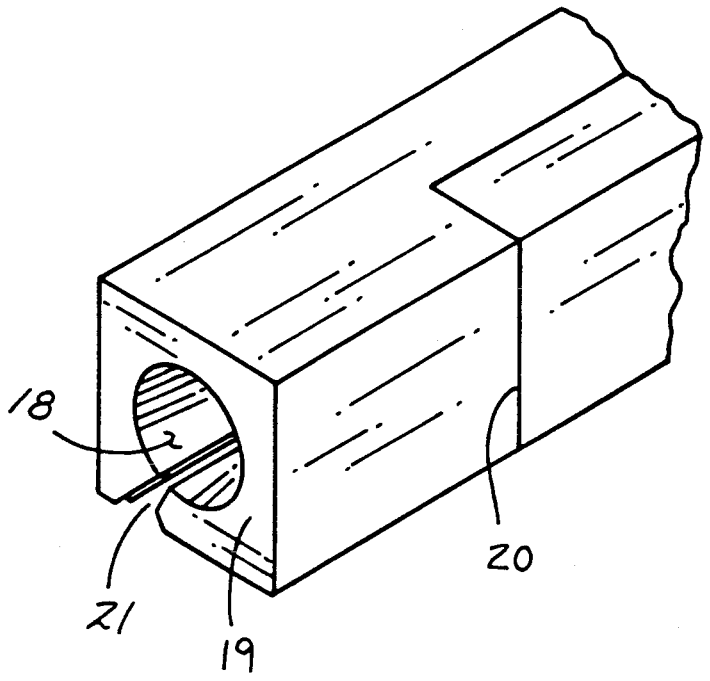
FIG. 2

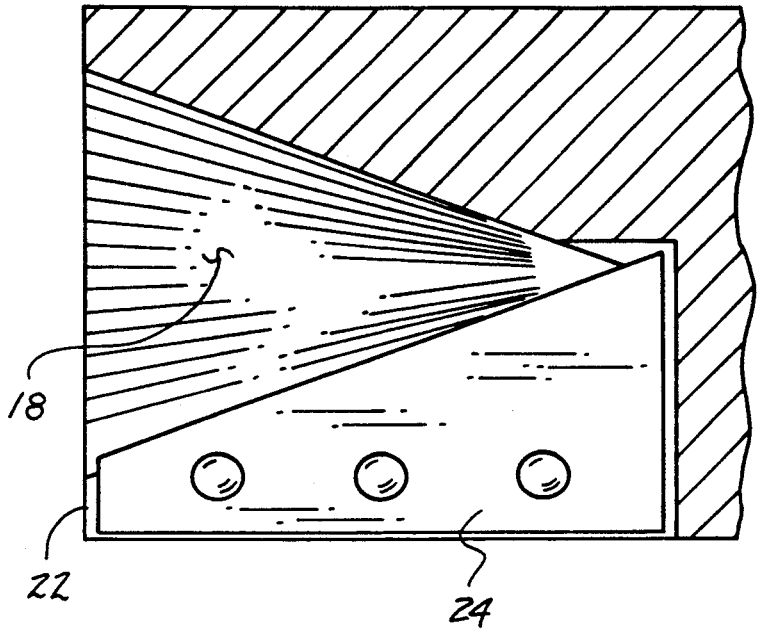
FIG. 3
FIG. 4
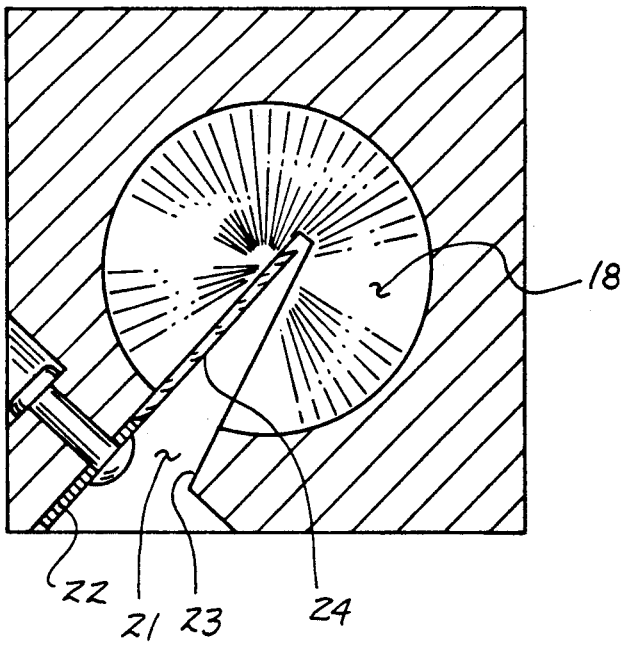

RAZOR KNIFE WITH BUILT-IN PENCIL SHARPENER

BACKGROUND OF THE INVENTION

1. Field of the Invention

The field of invention relates to utility knife structure, and more particularly pertains to a new and improved razor knife with built-in pencil sharpener arranged to provide for convenient and effective orientation of a pencil sharpener relative to the knife organization.

2. Description of the Prior Art

Utility knife structure of various types have been utilized in the prior art such as indicated in U.S. Pat. Nos. 4,320,576 and 5,036,591 as examples.

The instant invention attempts to overcome deficiency of the prior art by providing for the use of a pencil sharpener structure in cooperation with a knife blade inasmuch as the knife blade organization is employed by carpenters and the like having pencils, wherein the maintaining of the pencils in a sharpened conduction relative to the outlining of various indicia to permit subsequent severing is required in the craft and in this respect, the present invention substantially fulfills this need.

SUMMARY OF THE INVENTION

In view of the foregoing disadvantages inherent in the known types of utility knife apparatus now present in the prior art, the present invention provides a razor knife with built-in pencil sharpener having a pencil sharpener arranged in a spaced aligned relationship relative to an associated knife organization. As such, the general purpose of the present invention, which will be described subsequently in greater detail, is to provide a new and improved razor knife with built-in pencil sharpener which has all the advantages of the prior art utility knife apparatus and none of the disadvantages.

To attain this, the present invention provides a utility razor knife for use by carpenters and the like arranged to include a reciprocating blade mounted to a forward end of the structure, with a rearwardmost end of the housing structure including a pencil sharpener structure permitting access in the sharpening of a pencil in association with the knife blade arrangement.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved razor knife with built-in pencil sharpener which has all the advantages of the prior art utility knife apparatus and none of the disadvantages.

It is another object of the present invention to provide a new and improved razor knife with built-in pencil sharpener which may be easily and efficiently manufactured and marketed.

It is a further object of the present invention to provide a new and improved razor knife with built-in pencil sharpener which is of a durable and reliable construction.

An even further object of the present invention is to provide a new and improved razor knife with built-in pencil sharpener which is susceptible of a low cost of manufacture with regard to both materials and labor, and which accordingly is then susceptible of low prices of sale to the consuming public, thereby making such razor knives with built-in pencil sharpeners economically available to the buying public.

Still yet another object of the present invention is to provide a new and improved razor knife with built-in pencil sharpener which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention.

FIG. 2 is an enlarged isometric illustration of an end portion of the knife structure.

FIG. 3 is a cross-sectional illustration along a longitudinal axis of the knife assembly indicating the configuration of the cavity of the pencil sharpener structure.

FIG. 4 is ann orthographic cross-sectional illustration of the pencil sharpener structure, as indicated in FIG. 3, illustrating the orientation of the pencil sharpener blade relative to the pencil receiving cavity of the pencil sharpener.

DESCRIPTION OF THE PREFERRED EMBODIMENT

Figure 5:
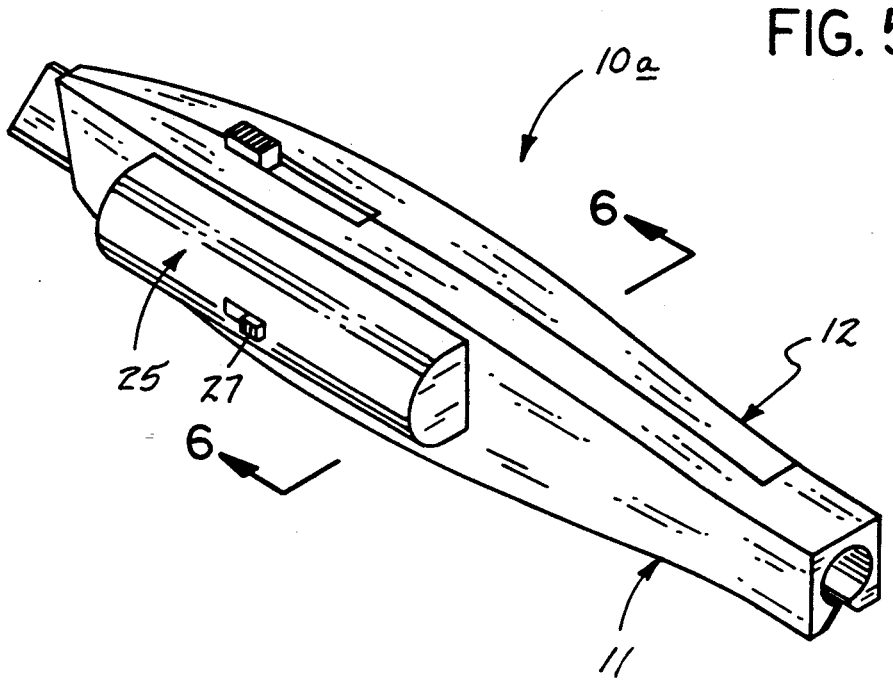
FIG. 5 is an isometric illustration of a modified aspect of the invention.
Figure 6:
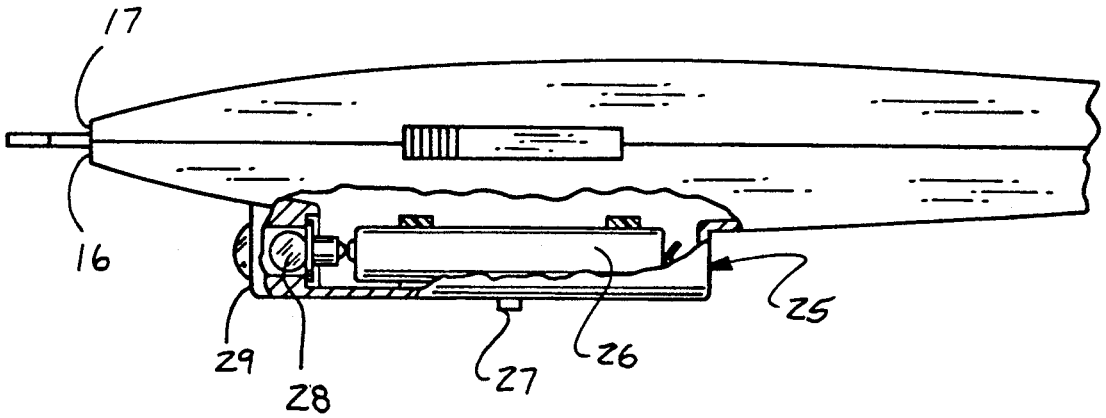
FIG. 6 is an orthographic top view, partially in section, of the organization as indicated along the lines 6—6 of FIG. 5 in the direction indicated by the arrows.

With reference now to the drawings, and in particular to FIGS. 1 to 8 thereof, a new and improved razor knife with built-in pencil sharpener embodying the principles and concepts of the present invention and generally designated by the reference numerals 10 and 10*a* will be described.

More specifically, the razor knife with built-in pencil sharpener 10 of the instant invention essentially comprises a first housing 11 mounted to a second housing 12, with the first housing and second housing screwed together by a fastener 13 directed orthogonally and intermediate the first and second housings, in a manner as indicated in U.S. Pat. No. 5,012,581 incorporated herein by reference. A slide member 14 is arranged to permit reciprocation of a cutting blade 15 relative to the first and second housing first ends 16 and 17 respectively. A conical bore 18 is directed into the first housing second end 19, with the conical bore 18 including a communicating slot 21 of a trapezoidal configuration (see FIG. 4). It should be noted that the second housing second end is arranged in a spaced orientation relative to the first housing first end to provide for an uninterrupted unitary pencil sharpener structure, in a manner as indicated in FIG. 2 for example.

The slot 21 includes a slot first side wall 22 spaced from a slot second side wall 23, with a slot first side wall 22 having a first side wall cutting blade 24 projecting into the conical bore 18, whereupon projection of a pencil within the conical bore 18 effects sharpening upon rotation of the pencil within the bore 18.

The FIG. 5 indicates the use of an illumination housing 25 mounted to the first housing 11 in a spaced relationship between the first and second ends of the first housing, such that a battery 26 is contained within the illumination housing 25 and operative through a switch 27 to effect selective illumination of illumination bulb 28 to direct illumination through an illumination housing front wall 29 that is arranged in a spaced parallel relationship relative to the first and second housing first ends 16 and 17 respectively. Spacing of the illumination housing front wall 29 in this manner affords protection to the illumination housing in use.

Figure 7:
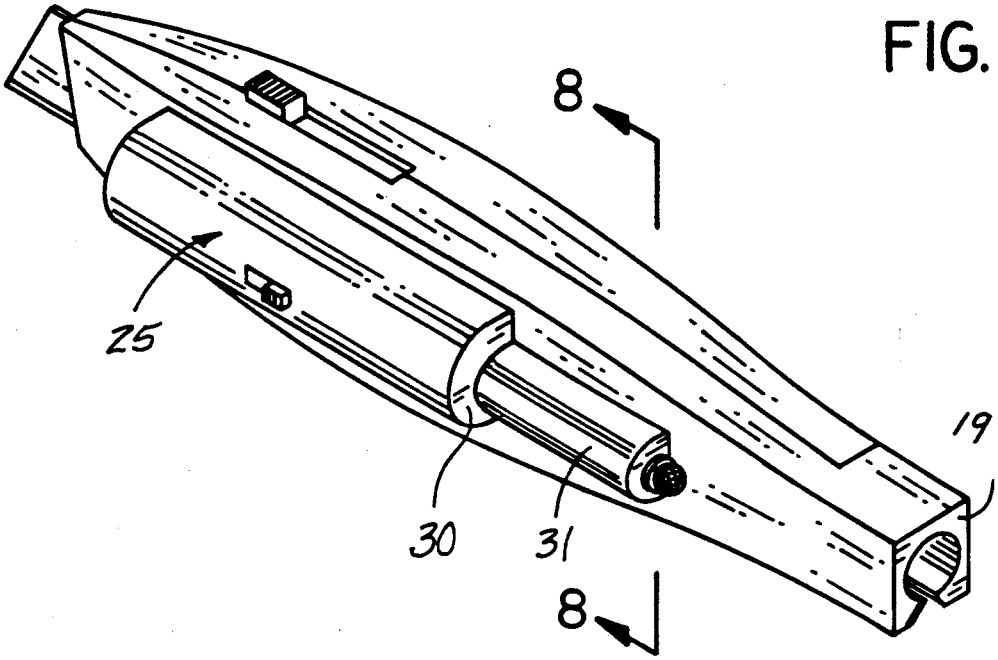
FIG. 7 is an isometric illustration of the modified aspect of the invention further including a scribe mounted within a scribe housing.
Figure 8:
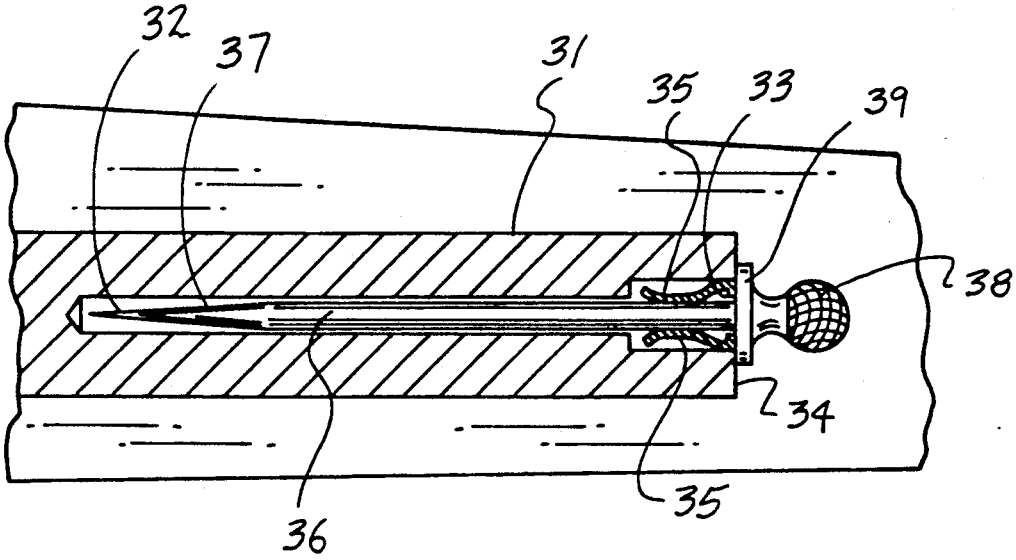
FIG. 8 is an orthographic view, taken along the lines 8—8 of FIG. 7 in the direction indicated by the arrows.

The FIGS. 7 and 8 further includes a scribe housing 31 integrally mounted to the illumination housing rear wall 30, with the scribe housing 31 including a scribe housing bore 32 directed into a scribe housing rear wall 34 oriented between the illumination housing rear wall 30 and the first housing second end 19. A scribe housing bore entrance 33 receives a scribe rod 36 having a pointed forward end 37, with spring plates 35 positioned within the scribe housing bore adjacent the entrance 33 to effect securement of the scribe rod 33 for storage thereof. The scribe rod 36 includes a handle 38 having an abutment plate 39 arranged for engaging the scribe housing rear wall 34 for proper positioning and orientation of the scribe rod 36 relative to the scribe housing 31. In this manner, the scribe is available for use upon various surfaces not accommodating a pencil line and the like, such as metallic surfaces and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a follows:

1. A razor knife with built-in pencil sharpener, comprising, a first housing and a second housing, the first housing arranged in adjacency to the second housing in contiguous communication, with the first housing having a first housing first end and the second housing having a second housing first end, with the first housing first end and the second housing first end arranged in a coplanar relationship to one another, and a slide member mounted in sliding relationship to the first housing and the second housing in operative communication with a cutting blade, with the cutting blade arranged for sliding projection through the first housing first end and the second housing first end, and the first housing including a first housing second end, with the first housing second end including a conical bore, and the first housing further including a slot, the slot intersecting the conical bore extending to the first housing second end, the slot having a trapezoidal cross-sectional configuration, and including a slot first side wall spaced from a slot second side wall, with the slot first side wall including a side wall cutting blade, with the side wall cutting blade projecting into the conical bore, and the second housing includes a second housing second end, the housing second end is arranged in a spaced relationship relative to the first housing second end, and an illumination housing mounted to the first housing, the illumination housing including a battery, with a switch directed through the illumination housing and an illumination bulb mounted within the illumination housing, the illumination housing including an illumination housing front wall spaced from an illumination housing rear wall, the illumination housing front wall arranged in adjacency to the illumination bulb, whereupon actuation of the switch effects illumination of the illumination bulb, with the illumination housing front wall arranged in a spaced parallel relationship relative to the first housing first end.

2. A razor knife as set forth in claim 1 including a scribe housing, the scribe housing integrally mounted to the illumination housing rear wall, the scribe housing including a scribe housing rear wall positioned intermediate the illumination housing rear wall and the first housing second end, with the scribe housing rear wall having an entrance, and the scribe housing including a scribe housing bore directed through the scribe housing in communication with the entrance, with the scribe housing bore including a plurality of spring plates, with a scribe rod received within the scribe housing bore through the entrance, with the spring plates arranged in contiguous communication with the scribe rod.

3. A razor knife as set forth in claim 1 wherein the scribe rod includes a pointed forward end, with a handle mounted to the scribe rod rear end, and an abutment plate mounted in adjacency to the handle in abutment with the scribe housing rear wall when the scribe rod is received within the scribe housing bore.

* * * * *